United States Patent [19]

Rohde et al.

[11] Patent Number: 4,817,703

[45] Date of Patent: Apr. 4, 1989

[54] STRIP CASTING UNIT WITH DOWNSTREAM MULTI-STAND CONTINUOUS ROLLING MILL

[75] Inventors: Wolfgang Rohde, Dormagen; Jürgen Seidel, Kreutzal, both of Fed. Rep. of Germany

[73] Assignee: SMS Schloemann-Siemag Aktiengesellschaft, Dusseldorf, Fed. Rep. of Germany

[21] Appl. No.: 118,584

[22] Filed: Nov. 6, 1987

[30] Foreign Application Priority Data

Nov. 6, 1986 [DE] Fed. Rep. of Germany ..... 3637893

[51] Int. Cl.[4] ..... B21B 1/26; B21B 1/46; B21B 13/22; B22D 11/12

[52] U.S. Cl. ..... 164/476; 29/527.7; 164/417

[58] Field of Search ..... 164/476, 417; 29/527.6, 29/527.7, 33 C

[56] References Cited

U.S. PATENT DOCUMENTS

| | | | |
|---|---|---|---|
| 3,358,358 | 12/1967 | Jenks et al. | 164/476 |
| 3,491,823 | 1/1970 | Tarmann et al. | 164/476 |
| 3,680,623 | 8/1972 | Tarmann et al. | 164/476 |
| 3,710,841 | 1/1973 | Baumann | 164/476 |
| 4,519,118 | 5/1985 | Shinopulos et al. | 29/527.7 X |

FOREIGN PATENT DOCUMENTS

| | | | |
|---|---|---|---|
| 3241745 | 5/1984 | Fed. Rep. of Germany . | |
| 53-112247 | 9/1978 | Japan | 29/527.7 |
| 54-153750 | 12/1979 | Japan | 29/527.7 |
| 55-50912 | 4/1980 | Japan | 29/567.7 |
| 58-100903 | 6/1983 | Japan | 29/527.7 |
| 60-121009 | 6/1985 | Japan | 29/527.7 |

*Primary Examiner*—Nicholas P. Godici
*Assistant Examiner*—J. Reed Batten, Jr.
*Attorney, Agent, or Firm*—Herbert Dubno

[57] ABSTRACT

A process and apparatus for making hot-rolled steel strip from a striplike continuously cast starting material uses successive processing steps in which the striplike cast starting material after solidification is brought to the hot rolling temperature and fed to a multi-stand rolling mill for rolling to the finished rolled product. A continuous casting unit supplies the multi-stand rolling mill. The rolling to the finished rolled product occurs continuously in three or four roll stands to achieve the largest possible reduction per pass. The first two roll stands operate with an approximately maximum rolling moment and a large working roll diameter.

11 Claims, 5 Drawing Sheets

STRIP CASTING UNIT WITH DOWNSTREAM MULTI-STAND CONTINUOUS ROLLING MILL

FIELD OF THE INVENTION

Our present invention relates to a process and apparatus for making hot-rolled steel strip from a striplike continuously cast starting material in successive process steps.

BACKGROUND OF THE INVENTION

The known process and apparatus for making hot-rolled steel strip from a striplike continuously cast starting material use successive processing steps in which the striplike continuously cast starting material after solidification is brought to the hot rolling temperature and fed to a multi-stand rolling mill for rolling to the finished rolled product.

Of course attempts have already been made to further roll continuously cast starting material issuing continuously from a continuous casting unit. The principal difficulty with this arises because the maximum casting speed with which the casting leaves the continuous casting unit is much less than the lowest possible rolling speed of a conventional line of rolls comprising the multi-stand rolling mill which for example can include seven roll stands.

The striplike starting material used to form the casting generally has a thickness in the range between 25 to 60 mm. If one starts with a central strip thickness of about 40 mm produced by a casting speed of about 0.13 m/s and presumes that the strip should be rolled to a thickness of 2 mm, there must be a twenty fold change.

In continuous operation under the supposition that the casting speed is equal to the inlet speed in the first roll stand in a tandem line with seven roll stands, the resulting outlet speed at the last roll stand is about 2.67 m/s.

The minimum outlet speed with a rolled product thickness of 2 mm amounts to about 10 m/s however, since at the lower speed an excessive temperature decrease makes the rolling impossible.

This problem could be dealt with now in two ways. In one approach a multi-stand continuous rolling mill or line of rolls is replaced by a powerful shaping unit (e.g. a planet rolling mill) which operates with a reduced entrance speed at the roll stand and with which a high reduction per pass can be attained (see Berg- and Hüttenmannische Monatshefte, Vol. 107. Jg., page 149).

However up to now no satisfactory results have been obtained even with very expensive special structures, the uniformity of the rolled stock was lacking.

A process known from German Open Patent Application No. DE-OS 32 41 745 proposes a solution. The striplike casting is rolled up into a roll or bundle and, after heating, is again unrolled and fed to a rolling mill for rolling to its final cross section. The rolling mill is then a pin or peg rolling mill or a finishing rolling mill group of a hot strip rolling mill.

Disadvantageously this known unit has a high investment cost for a multi-stand tandem line which may run over 40 million dollars. These high costs are only compensated when the konti line of rolls is completely balanced. Therefore as set forth in the named reference, the konti line is put in front of a multi-branch continuous casting unit. However because of that the total cost of the plant is increased in addition to the output capacity of the entire unit which in many applications is not at all necessary.

OBJECTS OF THE INVENTION

It is an object of our invention to provide an improved process for making hot-rolled steel strip and a strip casting unit with a downstream multi-stand rolling mill for performing that process which will overcome drawbacks of the prior art.

It is also an object of our invention to provide an improved process for making hot-rolled steel strip and a strip casting unit with a downstream multi-stand rolling mill with which the above named disadvantages are avoided and the difficulties removed.

It is also another object of our invention to provide an improved strip casting unit with a downstream multi-stand rolling mill with which small quantities can be worked economically, i.e. with a better balancing of use and particularly with a reduced investment cost.

SUMMARY OF THE INVENTION

These objects and others which will become more readily apparent hereinafter are attained in accordance with our invention in a process and apparatus for making hot-rolled steel strip from a striplike continuously cast starting material which uses successive processing steps in which the striplike continuously cast starting material after solidification is brought to the hot rolling temperature and fed to a multi-stand rolling mill for rolling to the finished rolled product. A continuous casting unit supplies the multi-stand rolling mill.

According to our invention the rolling to the finished rolled product occurs continuously in three or four roll stands at a maximum with the largest possible reduction per pass. Preferably only these roll stands are used.

Without the steps of our inventive process additional expense for other devices is required. With the three or four roll stand rolling mill the same reduction as with the conventional six to seven roll stand rolling mill is attained. The investment cost for the continuous roll line can even be considerably reduced in this way while simultaneously fitting the technologically attainable roll speed to the casting speed.

Skilled workers in the field up to now have always feared that with a reduction of the roll stand number and an increase in the reduction per pass the technological boundary conditions could no longer be satisfied.

These conditions are essentially a maximum transmittable torque, a maximum transmittable rolling force (linear load between the backing rolls and the working rolls as well as the roll stand structure) and a limiting angle of rolling in the roll gap.

As a result of the higher reduction per pass and the reduced heat loss with reduced roll stand number, however, now according to our invention the roll speed can be significantly reduced (from about 10–11 m/s to 4–6 m/s), whereby a reduction of the entire drive power and a reduction of plant wear occurs, i.e. a reduction of costs on the electrical and mechanical side.

According to an advantageous example of the process of our invention the first two of the roll stands have a large working roll diameter (at least 400 mm) and an approximately maximum rolling moment. The increase of the limiting angle of rolling as a result of the large reduction is thus compensated by increasing the working roll diameter and by lowering the roll speed since the gripping ability climbs with a reduction of roll speed.

In another example of our invention the drive for the third and/or fourth roll stand occurs by backing rolls. Especially with very small final cross sections under 2 mm thickness this kind of operation is meaningful.

Advantageously the starting material can be temporarily stored before introduction to the line of rolls of the roll stands. In this way the technologically provided different speeds of the strip casting unit and the hot-rolled strip rolling mill can be optimized. The temporary storage device can thus be both a storing oven with transverse transport of strip pieces or also a correspondingly longer continuous heating furnace.

It is particularly advantageous when the process of our invention rolls a smaller rolled product strip having a width between 1000 to 2000 mm, particularly 1350 mm, and is used to roll rolled product strip of reduced strength.

The objects of our invention are also attained in a strip casting unit with associated multi-stand continuous rolling mill for making hot-rolled steel strip from a striplike continuously cast starting material in successive process steps in which the continuous rolling mill comprises three or at most four roll stands. Furthermore the working rolls of the continuous rolling mill can be directly driven and the third and/or (if present) the fourth roll stand can be driven by driven backing rolls. Especially all of the working rolls of the continuous rolling mills can have equal roll diameters. With these features the costs of the storing can be minimized.

BRIEF DESCRIPTION OF THE DRAWING

The above and other objects, features and advantages of our invention will become more readily apparent from the following specific description, reference being made to the accompanying drawing in which.

Figure 3:
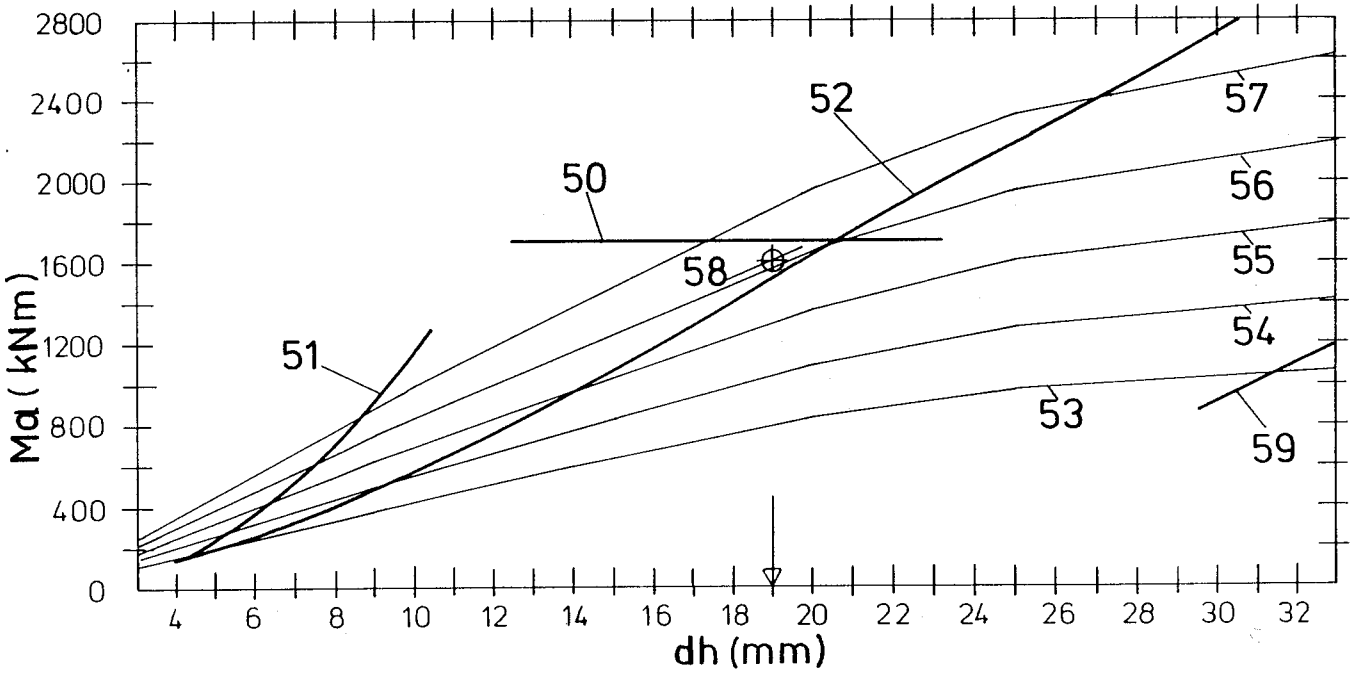
Figure 4:
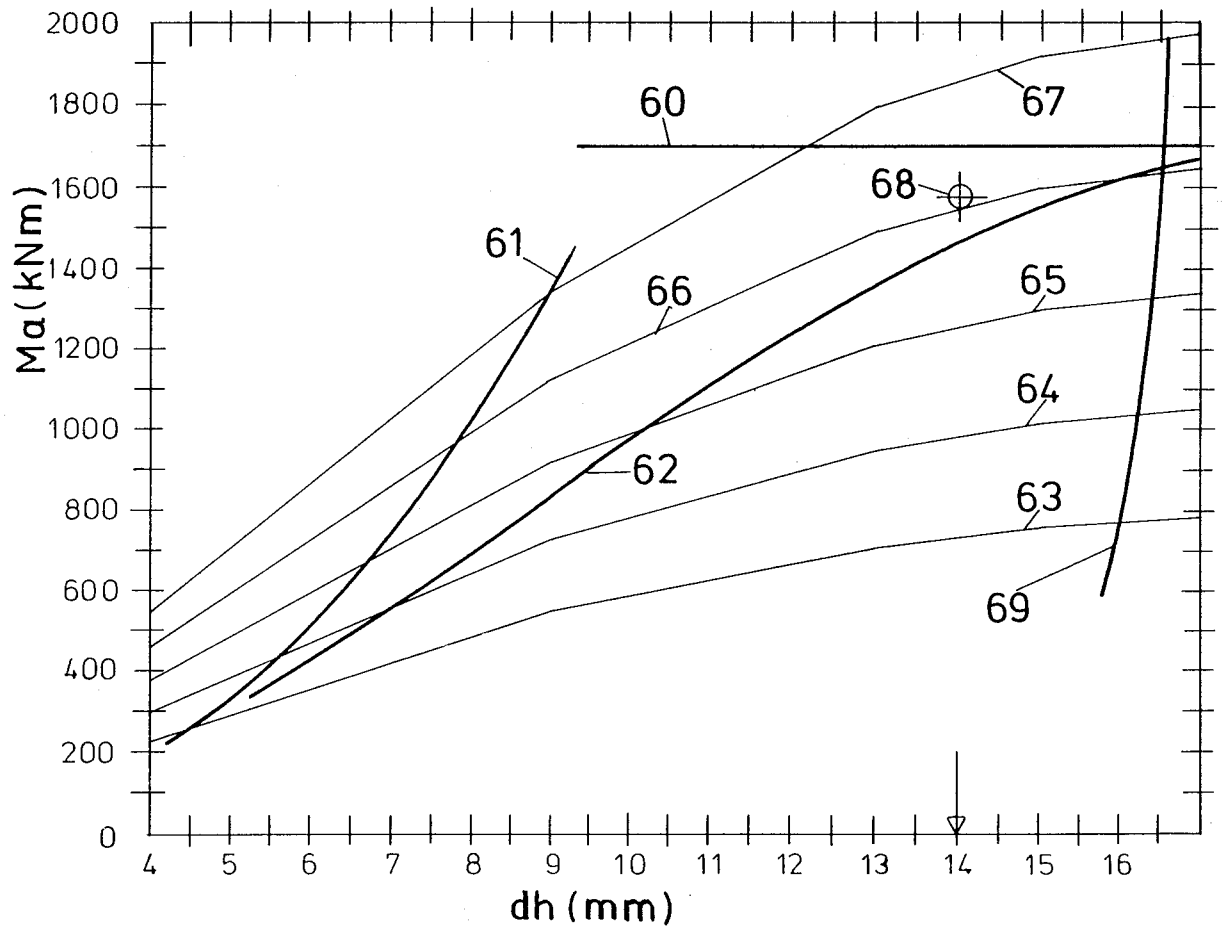
Figure 5:
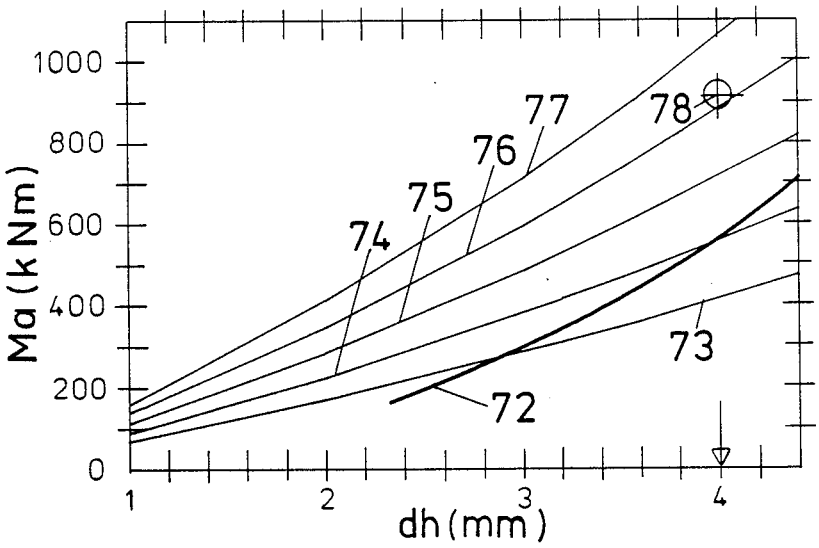

FIGS. *2a–d* are graphical representations of relationships for the roll drive in four roll stands according to the process of our invention;

FIG. 3 is a graphical representation of the reduction per pass in a first roll stand;

FIG. 4 is a graphical representation of the reduction per pass in a second roll stand; and FIG. 5 is a graphical representation of the reduction per pass in a third and last roll stand.

SPECIFIC DESCRIPTION

Figure 1:
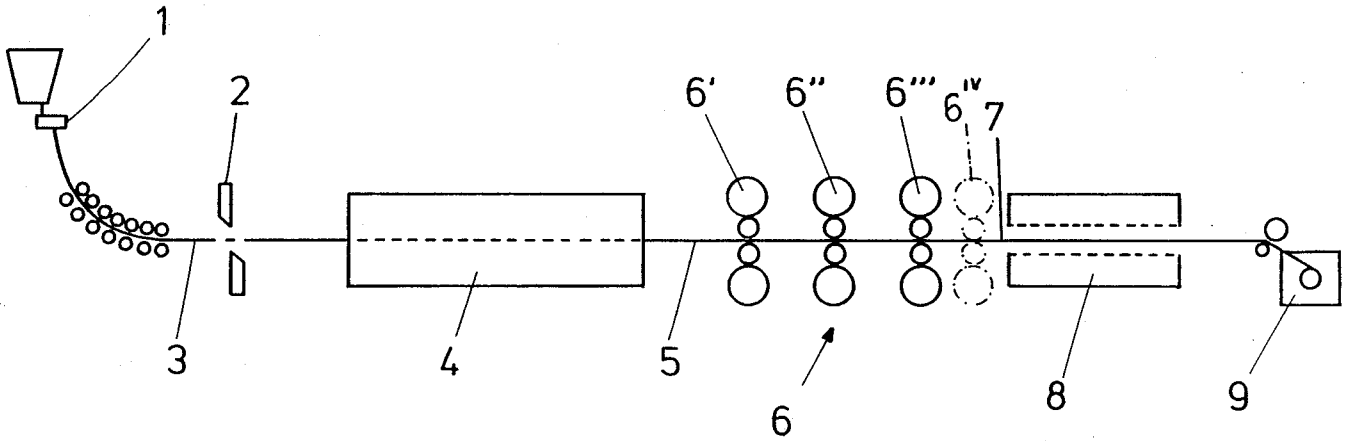
FIG. 1 is a schematic side elevational view of one example of an apparatus for making hot-rolled steel strip according to our invention.
Figure 2A:
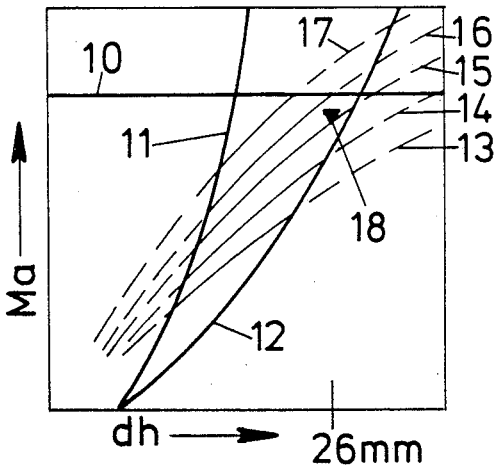
Figure 2B:
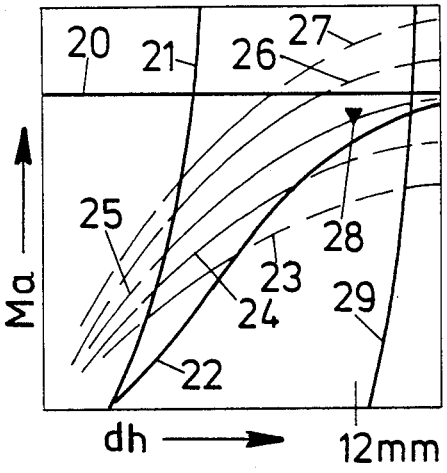
Figure 2C:
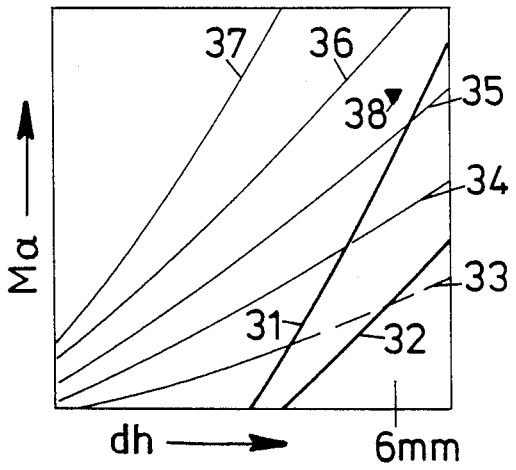
Figure 2D:
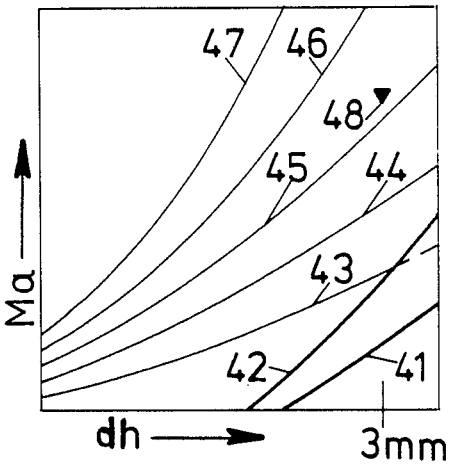

A strip casting unit 1 (FIG. 1) is followed by a cross cutting device 2, which can represent e.g. a flame cutting unit or other cutter, for cutting the cast strip 3 leaving the strip casting unit into pieces of equal length.

The individual strip pieces are temporarily stored in a storing and heating device 4, e.g. a rolling hearth furnace, and are brought to a homogeneous hot rolling temperature of from about 1050° to 1100° C.

A piece 5 leaving the oven 4 is descaled in a known way and if necessary brought to a new strip length (not shown).

After that the strip piece 5 is rolled from an initial thickness to the final rolled thickness in a train of rolls 6 comprising three (or four) roll stands (6', 6'', 6'''). After leaving the last roll stand (6''') of the train of rolls 6 with an outlet temperature of about 860° C., the finished strip 7 runs through a cooling device 8 to be rolled up subsequently by an underground or below-floor reel 9 at a temperature of about 560° C. When desired although by no means necessary, a fourth stand 6IV can be provided in the line.

The reduction per pass and the roll parameters are illustrated graphically for the four roll stands in FIGS. *2a* and *2d*. The thickness decrease "dh" in mm of the rolled product is shown on the abscissa and the sum of the effective roll moments "Ma" in kNm is shown on the ordinate.

An entrance gap for the strip material of 50 mm for the first roll stand is presumed in FIG. *2a*. The maximum transmittable roll moment 10 with a certain working roll diameter 13–17 intersects the curves 11, 12 as a horizontal line.

The curve 11 shows the roll moment limit with driven backing rolls with a friction value (coefficient of friction) of mu=0.15 and the curve 12 shows the roll moment limit with working rolls driven.

The similar curves for working roll diameter (13–17) increase upwardly in the region from 400 to 800 mm. Using a nearly maximum roll moment with a certain and comparatively large working roll diameter (between curves 15 and 16) with driven working rolls the operating point 18 for the first roll stand can be selected so that the thickness decrease for example amounts to about 26 mm. Thus a residual thickness after the first roll stand of 50−26=24 mm remains. This is the thickness of the piece introduced into the second roll stand. The related thickness decrease and/or reduction per pass attains a value of 52 %.

The dependence of the roll moment and the thickness decrease is shown in FIG. *2b* with curves labelled with reference numbers 23–27 which increase with increasing working roll diameter.

Using the maximum transmittable roll moment in the second roll stand with advantageously the same working roll diameter as above the operating point 28 (between 25 and 26) is in the permissible region above the curve 22 for the maximum transmittable roll moment with driven working rolls, however is outside of the permissible region for the driven backing rolls 21 with a thickness decrease of, for example, 12 mm.

Thus a residual thickness of 24−12=12 mm remains corresponding to a related reduction per pass of 50%. The permissible working field between the curves 22 and 21 is bounded on the right by a curve 29 defining a maximum limiting angle of rolling.

Curves showing the dependence of the roll moment and the thickness decrease are indicated in FIG. *2c* with reference numbers 33–37 which increase with increasing working roll diameter. The set thickness decrease is for example 6 mm with a residual thickness of 6 mm corresponding to a related thickness decrease of 50%. The selected operating point 38 lies under the maximum transmittable rolling moment in the permissible region of the rolling moment curve for the driven backing rolls 31 so that the working rolls can be driven according to choice directly 32 or indirectly by the backing rolls 31.

In FIG. *2d* the curves showing the dependence of the rolling moment and the thickness decrease are similarly indicated with reference numbers 43 to 47 which increase with increasing working roll diameter in FIG. *2d*. The desired thickness decrease here is, for example, 3 mm with a final thickness of 3 mm corresponding to a related thickness decrease of 50%. The selected operating point 48 as in FIG. *2c* lies under the maximum transmitted roll moment in the permissible region of the roll moment curves 41, 42 for driven working and backing rolls so that the working rolls here, as also in the third roll stand, according to choice have their own drive 42 or are driven by the backing rolls 41.

The operating values for the reduction per pass in a first of three rolling mills are illustrated as a working graph in FIG. 3. Again the thickness decrease "dh" of the rolled product in mm is shown on the abscissa and the sum of the effective roll moment "Ma" in kNm is given on the ordinate. The results with working roll diameters increasing from 400 to 800 mm are illustrated at 53 to 57. Using the maximum transmitted roll moment of 1700 kNm with a working roll diameter of 710 mm, the operating point 58 (between 56 and 57) is in the permissible region above the curve for the maximum transmittable roll moment with driven working rolls 52 and outside the permissible region for the driven backing rolls 51, with a thickness decrease of 19 mm.

Thus from an initial thickness of 41 mm−19 mm a residual thickness of 22 mm remains corresponding to a related thickness decrease of 46.34%. The accessible working field between the curves 52 and 51 is not limited by the curve of maximum limiting angle of rolling 59.

An increasing working roll diameter depending on the roll moment and the thickness decrease is illustrated with curves having reference numbers 63–67 shown in FIG. 4. Using a maximum transmitted roll moment 60 of 1700 kNm in the second roll stand advantageously with the same working roll diameter as in the first roll stand (710 mm), the operating point 68 (between curves 66 and 67) is in the permissible region above the curve for the maximum transmittable roll moment with driven working rolls 62. However, point 68 is outside of the permissible region for the driven backing rolls 61 with a thickness decrease of 14 mm. Therefore a residual thickness of 22−14=8 mm remains corresponding to a related reduction per pass of 63.64%. The permissible working field between the curves 62 and 61 is bounded with a high reduction per pass on the right by the curve 69 defining a maximum limiting angle of rolling.

Curves for working roll diameters increasing from 400 to 800 mm are illustrated with the reference numbers 73–77 in FIG. 5. The set thickness decrease is here, for example, 4 mm to attain a residual thickness of 4 mm corresponding to a related thickness decrease of 50%. The chosen operating point 78 lies at 900 kNm with 4 mm thickness decrease far under the maximum transmittable roll moment in the permissible region of the roll moment curve for the driven backing rolls (not shown) and the driven working rolls 72.

The features of our invention are not to be limited by the examples shown in the drawing. Thus without exceeding the scope of our invention in the individual roll stands working rolls with different roll diameters and different roll geometries can be provided to optimize the individual conditions for the deformation. For example particularly relatively axially shiftable bottle rolls can be used for continuously changing the roll gap because of roll wear.

By "largest possible reduction per pass" we mean in the following claims the greatest decrease in thickness of the rolled product which is consistent with the maximum limiting angle of rolling, the permissible rolling moments and other rolling parameters.

By "rolling parameters" we include the reduction per pass, the limiting angle of rolling, the rolling moment and the roll force among others.

We claim:

1. In a process for making hot-rolled steel strip from a striplike continuously cast starting material in successive processing steps including bringing said striplike continuously cast starting material after solidification to the hot rolling temperature and subsequently feeding said starting material to a multi-stand rolling mill for rolling to a finished rolled product, the improvement wherein said rolling to said finished rolled product occurs continuously in from three to four roll stands with the largest possible reduction per pass, the first two of said roll stands are provided with a large working roll diameter and an approximately maximum rolling moment, and all of the working rolls of the continuous rolling mill are directly driven.

2. The improvement defined in claim 1 wherein the driving of the third and, where present, the fourth one of said roll stands occurs by at least one backing roll.

3. The improvement defined in claim 1 wherein said starting material is temporarily stored before introduction to the line of rolls of said roll stands.

4. The improvement defined in claim 1 wherein said finished rolled product is between 1000 to 2000 mm wide.

5. The improvement defined in claim 4 wherein said finished rolled product is about 1350 mm wide.

6. The improvement defined in claim 1 wherein said finished rolled product has reduced strength.

7. In a strip casting unit with an associated multi-stand continuous rolling mill having a plurality of working rolls for making hot-rolled steel strip from a striplike continuously cast starting material in successive process steps, said striplike continuously cast starting material being brought after solidification to the hot-rolling temperature and being fed to said continuous rolling mill for rolling to a finished rolled product, the improvement wherein said multi-stand continuous rolling mill comprises three or at most four roll stands, the first two of said roll stands have an approximately maximum rolling moment, and all of the working rolls of the continuous rolling mill are directly driven.

8. The improvement defined in claim 7 wherein said working rolls of the first two of said roll stands are directly driven and the third and, where present, fourth one of said roll lstands are driven by driven backing rolls.

9. The improvement defined in claim 7 wherein all of said working rolls of said continuous rolling mill have equal roll diameters.

10. A process for making hot-rolled steel strip from a striplike continuously cast starting material comprising:

a. bringing said striplike continuously cast starting material after solidification to a hot rolling temperature;

b. temporarily storing said striplike continuously cast starting material; and c. then feeding said striplike continuously cast starting material to a multi-stand rolling mill with from three to four roll stands with the highest possible reduction per pass, the first two of said roll stands being operated with an approximately maximum roll moment and a working roll diameter at least equal to 400 mm and the third and, where present, fourth one of said roll stands being driven by at least one backing roll, and all of the rolls of said roll stands are directly driven.

11. A process defined in claim 10 wherein the rolling parameters of said multi-stand rolling mill are chosen so that said finished rolled product has a width between 1000 to 2000 mm.

* * * * *